US005404151A

United States Patent [19]

Asada

[11] Patent Number: 5,404,151

[45] Date of Patent: Apr. 4, 1995

[54] SCANNING CIRCUIT

[75] Inventor: Hideki Asada, Tokyo, Japan

[73] Assignee: NEC Corporation, Tokyo, Japan

[21] Appl. No.: 920,783

[22] Filed: Jul. 28, 1992

[30] Foreign Application Priority Data

Jul. 30, 1991 [JP] Japan ..... 3-189083
Oct. 25, 1991 [JP] Japan ..... 3-279365

[51] Int. Cl.[6] ..... G09G 3/36

[52] U.S. Cl. ..... 345/100; 345/204; 326/98; 326/113

[58] Field of Search ..... 307/480, 244, 279, 481; 328/153, 105; 345/98, 99, 100, 208, 204

[56] References Cited

U.S. PATENT DOCUMENTS 4,785,297 11/1988 Sekiya ..... 345/198
5,194,853 3/1993 Asada ..... 345/100

*Primary Examiner*—Alvin E. Oberley

*Assistant Examiner*—Minsun Oh

[57] ABSTRACT

A scanning circuit according to the invention has a form of integrated thin film transistors on a substrate, comprising a multiplicity of serially interconnected stages of pass transistors or clocked inverters for successive transmission of a signal with a predetermined delay. Each stage includes only one pass transistor or clocked inverter which is operated by a pair of mutually inverted clock puls. Each stage also comprises an output buffer circuit for providing a scanning signal having a frequency twice as large as said clock pulses by receiving the output of the corresponding pass transistor or clocked inverter via an NOR gate which is operated by one of tile paired clock pulses. The scanning circuit is thus capable of doubly fast scanning of a display, e.g. a high resolution display. The scanning circuit is simple in structure, so that it occupies only a small area on a substrate and gives high yield and reliability.

4 Claims, 6 Drawing Sheets

SCANNING CIRCUIT

FIELD OF THE INVENTION

The invention relates to a scanning circuit for use in peripheral driver circuits such as liquid crystal displays (LCDs), image sensors, and liquid crystal shutters.

BACKGROUND OF THE INVENTION

Art of manufacturing chin film driver circuits in the form of ICs (integrated circuits) has been applied to produce reliable yet low cost LCDs, image sensors, liquid crystal shutters and the like.

In one aspect the invention may improve manufacture yield for such ICs by forming such peripheral driver circuits on tile same substrate as the pixel electrodes so that connection terminals and external driver Ifs may be greatly reduced in number.

In another aspect tile invention may resolve a low reliability limitation pertinent to conventional process of IC manufacture which involves large area, high density bonding of IC elements.

In active matrix LCDs, for example, delay transfer circuit and output buffer circuitries included in a scanning circuit, which serves as a vertical drive circuit and hence an important element of a thin :Film driver circuit, are formed integrally with the pixel electrodes.

FIG. 1 shows a conventional scanning circuit, illustrating delay transfer circuit in an N-th stage 110 and N+1-st stage 120 of the circuit, each stage comprising 8 elements i.e. four pass transistors 101 and four inverters 102.

Such delay transfer circuit functions to transfer a received signal to the next-one with a prescribed delay in time. Thus, in this Figure, an input signal P to the delay transfer circuit of any one stage, the N-th stage 110, say, is transferred as the input P1 to the next stage, which is N+1-st stage in this example, a period of T later. This delay is a consequence of a shift operation of the corresponding delay transfer circuit in response to a clock pulse Φ1 and an inverted clock pulse $\overline{\Phi 1}$.

Associated with the shift operations of the registers, scanning signals S1 and S2 are derived from the corresponding delay transfer circuit via respective buffer circuitries 111 and 121.

FIG. 2 shows a timing chart for the conventional scanning circuit of FIG. 1. It is seen that an output signal P2 coming out of the output terminal B of the stage N+1 is delayed from that of output signal P1 from the terminal A of the preceding stage N by a drive period (or clock period) T. It is noted that the scanning signals S1 and S2 have a scanning period Tv which is the same as clock period T.

As may be anticipated from the above example, such conventional scanning circuit must occupy a relatively large area, since the circuit comprises as many as 8-elements in each delay transfer circuit. Furthermore, should one element become defective in any stage, scanning signals could not be correctly transferred any further, resulting in a defective picture on the display. From the point of reliability of the scanning circuit and hence the thin film drive circuit, this type of defect poses a serious problem, since it can happen without defect in pixel electrodes.

In addition, conventional scanning circuit cannot operate fast enough for high resolution displays which require much higher scanning speed. This is due to the fact that the scanning period of conventional scanning circuits is the same as the period of the clock.

SUMMARY OF THE INVENTION

An object of the invention is, therefore, to provide a scanning circuit occupying only a small area on a substrate.

Another object of the invention is to provide a scanning circuit capable of fast operation suitable for high resolution devices. It is still another object of the invention to provide a reliable or defect free scanning circuit to thereby furnish reliable LCDs.

A scanning circuit according to the invention has a form of integrated thin film transistors on a substrate, comprising a multiplicity of serially interconnected stages of pass transistors or clocked inverters for successive transmission of a signal with a predetermined delay. Each stage includes only one pass transistor or clocked inverter which is operated by a pair of mutually inverted clock pulses. Each stage also comprises an output buffer circuit for providing a scanning signal having a frequency twice as large as said clock pulses by receiving the output of the corresponding pass transistor or clocked inverter via an NOR gate which is operated by one of the paired clock pulses.

It should be noted that since the scanning circuit of the invention includes only one-element delay transfer circuit in each stage, it occupies only small area of the substrate.

It should be also noted that the invention improves the manufacture yield for the scanning circuit through improved, simplified structures of the scanning circuit. The simple -structured scanning circuit of the invention may yet transfer the signal through the stages with correct delay time.

It should be further noted that the scanning period of the scanning circuit of this invention is half that of a clock pulse, allowing for doubly fast scanning of a display. In other words, the scanning circuit permits of double scanning speed of a display as compared to conventional scanning. This may help improve resolution of a display.

DETAILED DESCRIPTION OF THE PREFERRED EMBODIMENT

Figure 1:
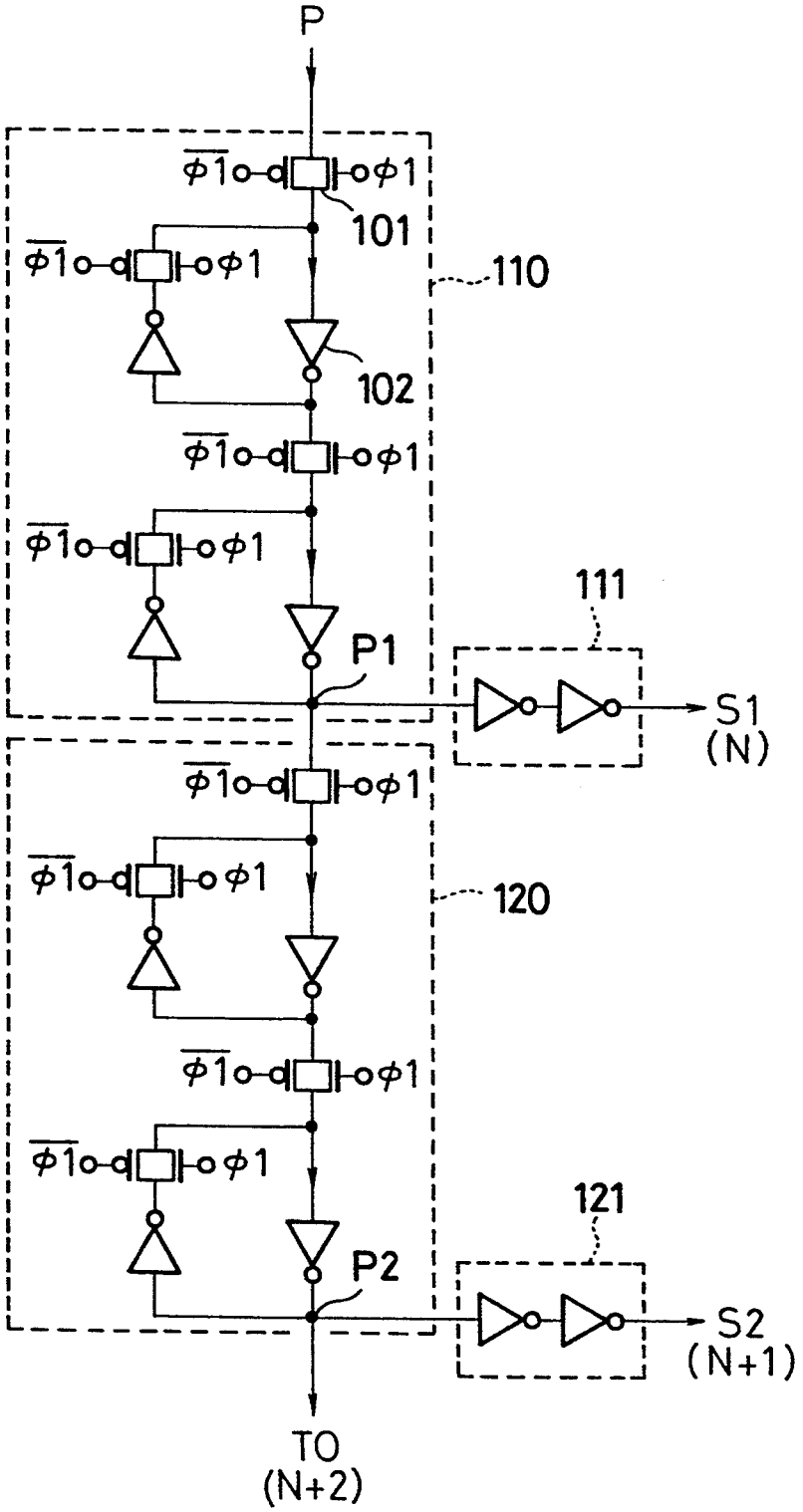
PRIOR ART FIG. 1
FIG. 1 shows a conventional scanning circuit.
Figure 2:
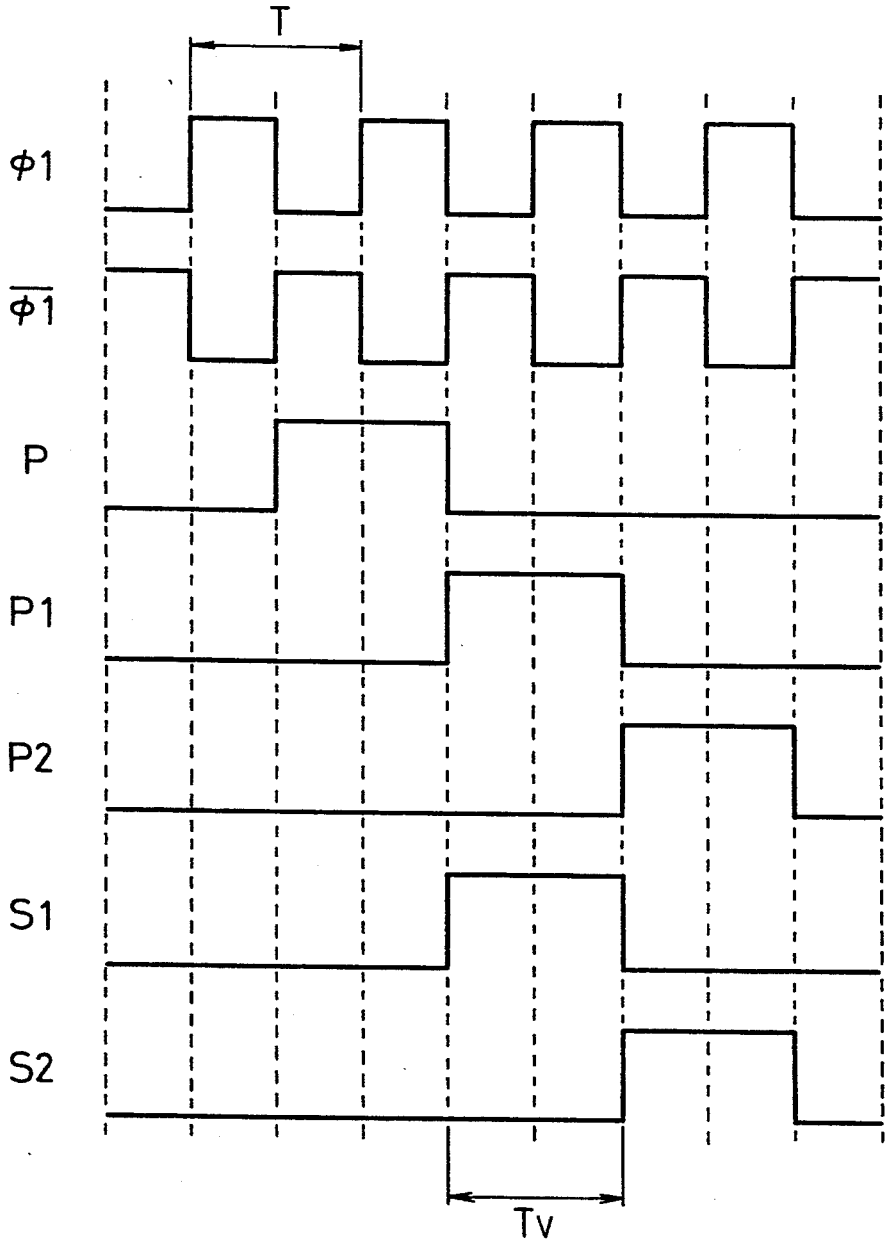
PRIOR ART FIG. 2
FIG. 2 is a timing chart for the scanning circuit shown in FIG. 1.
Figure 3:
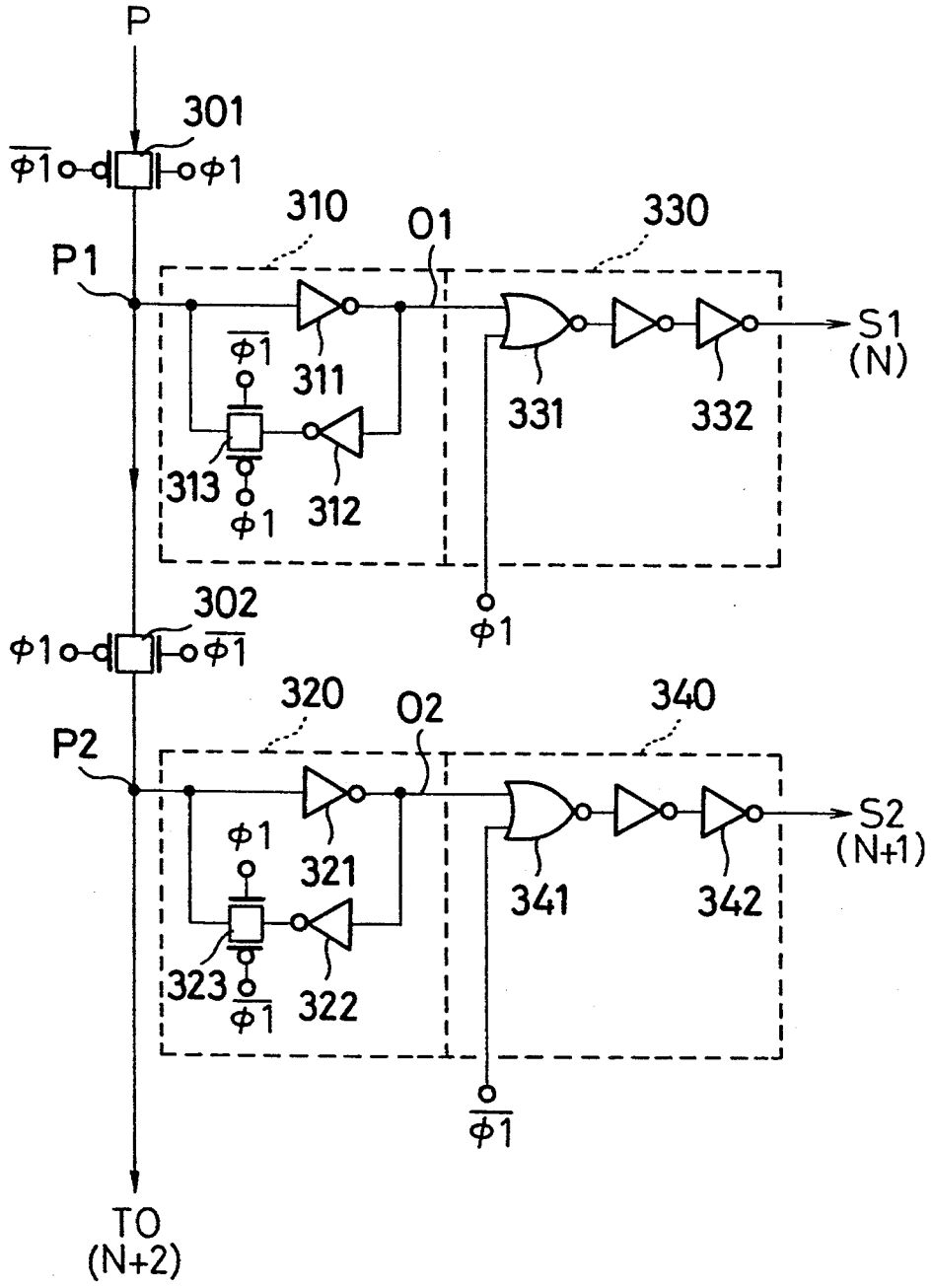
FIG. 3 shows a first scanning circuit embodying the invention.

FIG. 3 shows a first example of the invention, in which a scanning circuit is constructed as a CMOS static circuit.

The scanning circuit includes a delay trasfer circuit which comprises a given number of stages of single pass transistors 301 which are connected in series and operated by a pair of mutually inverted clock pulses Φ1 and $\overline{\Phi 1}$. The pass transistors 301 and 302 forms two consecutive stages N and N+1 respectively.

The output of the N-th stage is also connected to the input of a feedback circuitry 310, the output of which is in turn connected to an output buffer circuitry 330. The feedback circuitry 310 is provided for amplifying the attenuating output of the pass transistor. The feedback circuitry 310 comprises an inverter 311 and 312 and another pass transistor 313. The output buffer circuitry 330 comprises an NOR circuitry 331 for receiving the output of the feedback circuitry 310, and two inverters 332 connected in series for providing a scanning signal S1.

Figure 4:
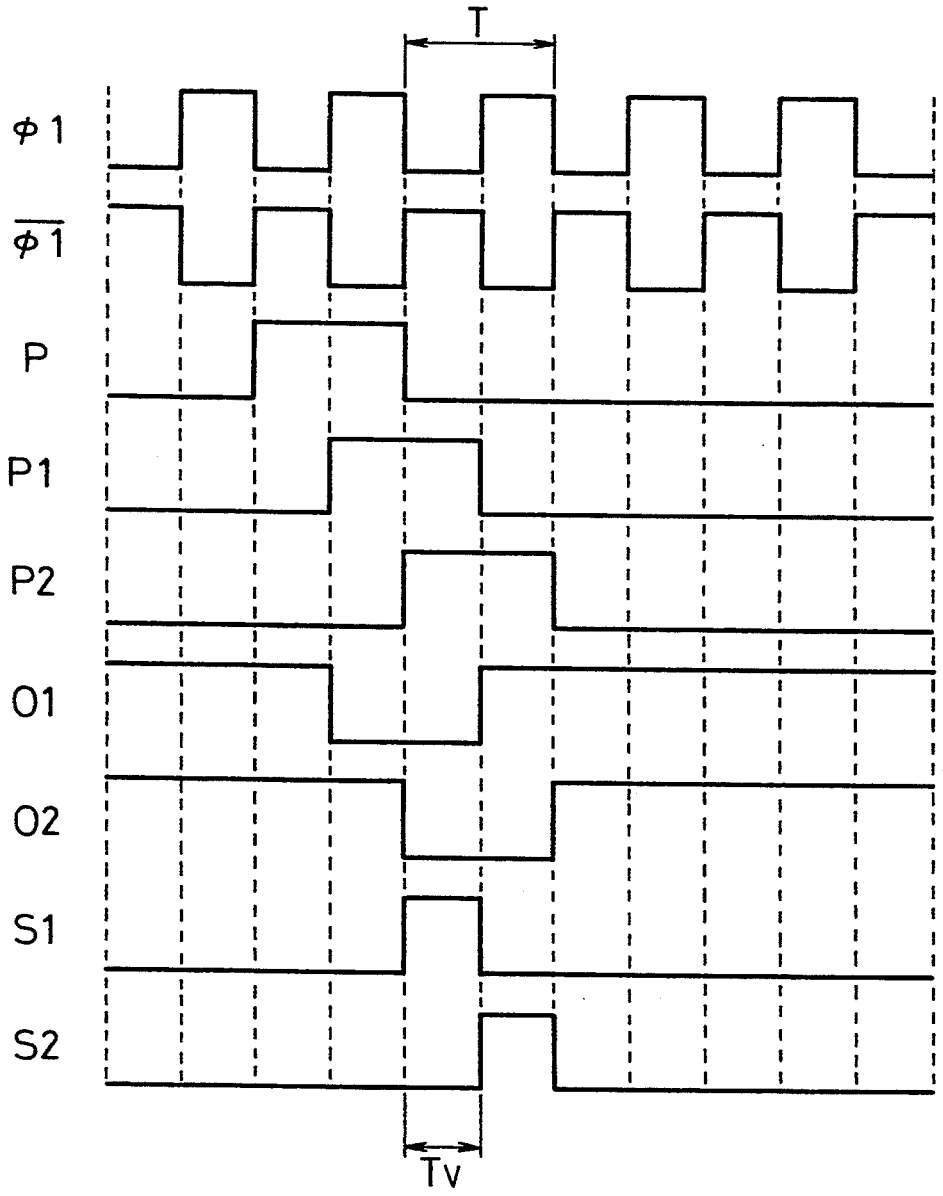
FIG. 4 shows timing charts for the first, a second, and a third scanning circuit according to the invention.

Assume now that in this arrangement a signal P having level "H" as shown in FIG. 4 is supplied to the pass transistor 301 of the stage N. The pass transistor 301 is activated by a pair of rising clock Φ1 and falling clock Φ1. The signal is delayed by ½ the clock period T and is output as a pass signal P1 to the feedback circuitry 310.

The signal P1 is then inverted by the inverter 311 before it is input to the gale 331 (NOR logic) of the output buffer circuitry 330 and at the same time re-inverted by the inverter 312 before it is supplied to the pass transistor 313, where the signal is synchronized by clock pulse $\overline{\Phi}$1. The signal is then positively fed back to the input of the feedback circuitry 310.

In this way the signal attenuated through the pass transistor 301 is amplified and output to the output buffer circuitry 330 associated with the stage N. This output signal O1 has level "L" and is supplied to the input of the NOR circuitry 331. The NOR circuitry 331 is also supplied with a clock signal Φ1. When both of the signals 01 and Φ1 have level "L", signal S1 of the stage N assumes level "H" and is output through two inverters 332.

On the other hand the pass signal P1 output from the N-th pass transistor 301 is supplied to the input of the next pass transistor 302 in the N+1 -st stage. In the manner described above this pass transistor 302 is activated by a pair of rising clock $\overline{\Phi}$1 and falling clock Φ1 to supply its output signal P2, which is delayed by ½ T from the signal P1, to the feedback circuit 320 and the next pass transistor (not shown) in the next stage.

Like the feedback circuit 310, this feedback circuit 320 in the N+1-st stage amplifies the signal input thereto and supplies the amplified signal to an output buffer circuitry 340 in the stage N+1. The output buffer circuitry 340 provides its output signal S2 in synchronism with the "L" level of the clock $\overline{\Phi}$1 and "H" level of the clock Φ1.

It should be noted chat the scanning signals S1, S2, etc from respective stages have a pulse width ½ T, which is half the period T of the clock signal Φ1 and $\overline{\Phi}$1 that they come out consecutively.

Further, because each delay transfer circuit consists of a single element, the number of the elements necessary for the delay transfer circuit in the above example of the invention is only ⅛ of a conventional one, thereby requiring only ⅛ area on a substrate in comparison to a conventional scanning circuit.

Because of this structural simplicity, manufacture yield for the scanning circuit is greatly improved by the invention. For example, in a case where 2000 stages of such delay transfer circuit are connected in series, reliability of the circuit or probability that a given input signal is correctly transferred down to the last stage is 90%, which is a great improvement over conventional ones for which the same probability is only 50%.

Thus, the invention may substantially eliminate image defects due to defect in thin film drive circuits and successfully improve the reliability of input/output devices for displays such as LCDs, image sensors, and LCD shutters.

In addition, the scanning circuit of the invention may complete one scanning frame in one half a period of conventional scanning period. In other words given a drive frequency (which is the frequency for driving the scanning circuit or clock frequency) the scanning frequency is two times the drive frequency. This is advantageous for high resolution LCDs, contact-type image sensors, and LCD shutters requiring fast scanning.

Figure 5A:
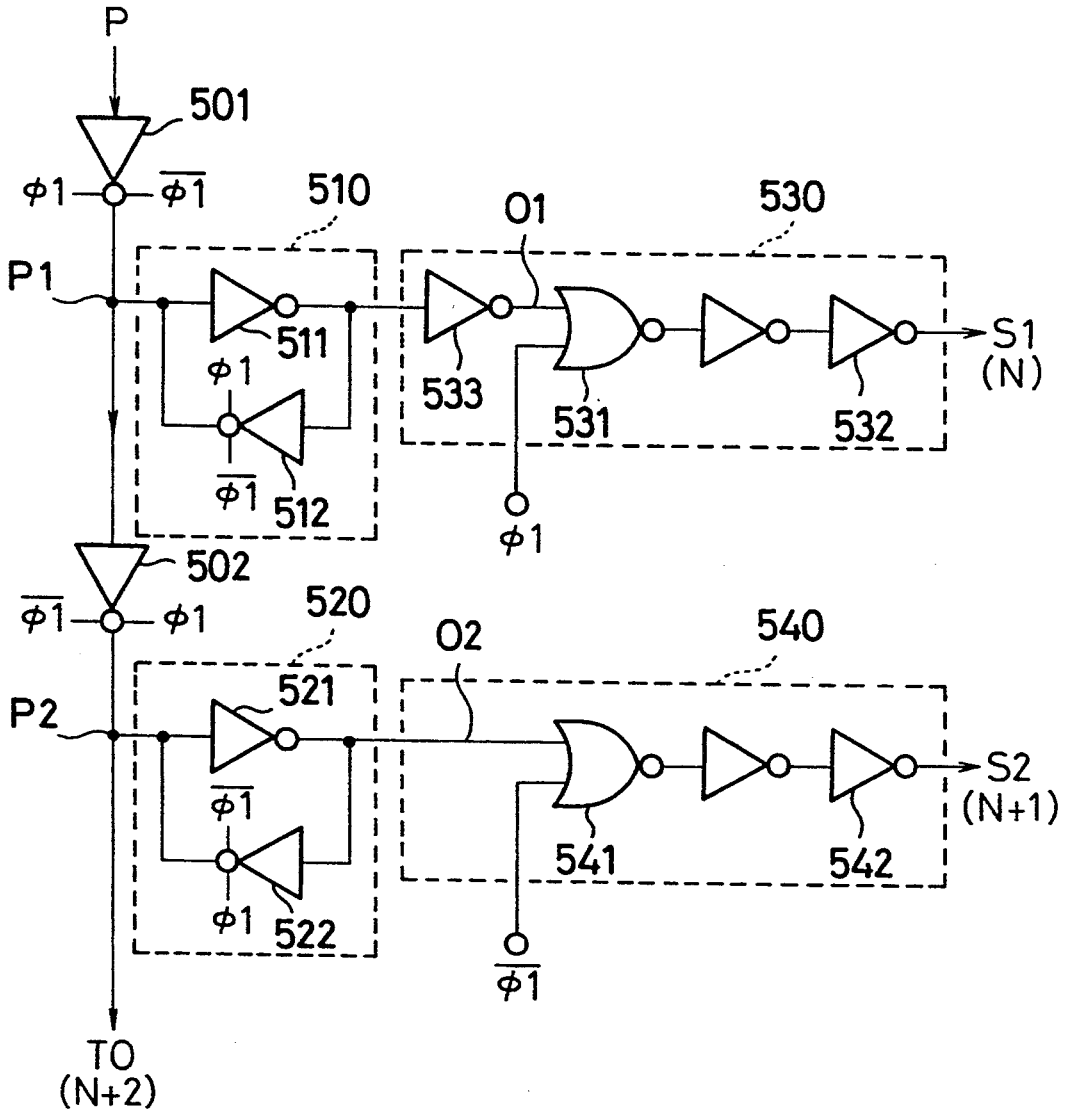
FIG. 5A is the second scanning circuit.

FIG. 5A shows a second example of the invention, which is also a CMOS static circuit.

As shown in the Figure, the arrangement of this example is the same as the first example above in that each stage also consists of a single element delay transfer circuit for transferring a signal to the subsequent stage and that, associated with each stage, are a feedback circuit 510 for extracting the signal and an output buffer circuitry 530 for providing a scanning signal. However, the second example differs from the first in that the one-element delay transfer circuit is a clocked inverter 501, that the positive feedback element in the feedback circuit 510 is a clocked inverter 512 for synchronizing a received scanning signal, and further that an additional inverter 533 is coupled to the gate 531 of the output buffer circuitry 530 associated with a first of a pair of two consecutive delay transfer circuits 501 and 502 which are driven by mutually inverted clock signals Φ1 and $\overline{\Phi}$1.

Figure 5B:
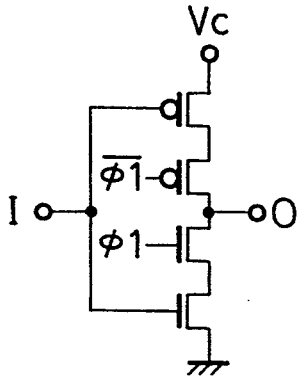
FIG. 5B shows the detailed internal structure of the clocked inverter.

FIG. 5B shows the detailed internal structure of the clocked inverter 501. As indicated in the Figure, when the clock Φ1 is "H" and clock $\overline{\Phi}$1 is "L", the inverter outputs a signal which is inverted with respect to the input signal I On the other hand, when the clock Φ1 is "L" and the clock $\overline{\Phi}$1 is "H", the inverter holds the inverted output.

With this arrangement of the delay transfer circuit 501, the inverter 501 receiving an input signal P is activated by a pair of rising clock Φ1 and falling clock $\overline{\Phi}$1 to provide an inverted output signal 01 ½ T later, where T is the clock period. The output signal 01 is supplied to the feedback circuit 510.

The inverted signal 01 is re-inverted by the inverter 511 before it is supplied to the output buffer circuitry 530, and at the same time coupled to the input of the feedback circuit 510 for positive feed back via a clocked inverter 512 where the signal is synchronized with the rising clock $\overline{\Phi}$1 and falling clock Φ1.

The signal output from the feedback circuit 510 is provided to the NOR gate 531 via the inverter 533 which is included on the input end of the output buffer circuitry 530. The signal is converted by the output buffer circuit 530 to a desired scanning signal S1 and provided on the output thereof.

Subsequent operations of the scanning circuit are the same as in the first example. Thus, scanning signals S1 and S2 are available from corresponding stages during a period T of clock Φ1 and $\overline{\Phi}$1, as shown in the Liming chart of FIG. 4.

It should be noted that the scanning signals S1, S2, etc available from these stages come out consecutively, and that the signals have a pulse width which is one half the period T of the clock Φ1 and $\overline{\Phi}$1. That is, two scanning signals S1 and S2 may be obtained for one period T of a clock.

Because a delay transfer circuit in each stage consists of a single element as in the preceding examples, this scanning circuit requires much less area of substrate and provides much higher yield and reliability compared to the conventional ones. Further, this scanning circuit may also double the scanning frequency for a given clock frequency.

Figure 6:
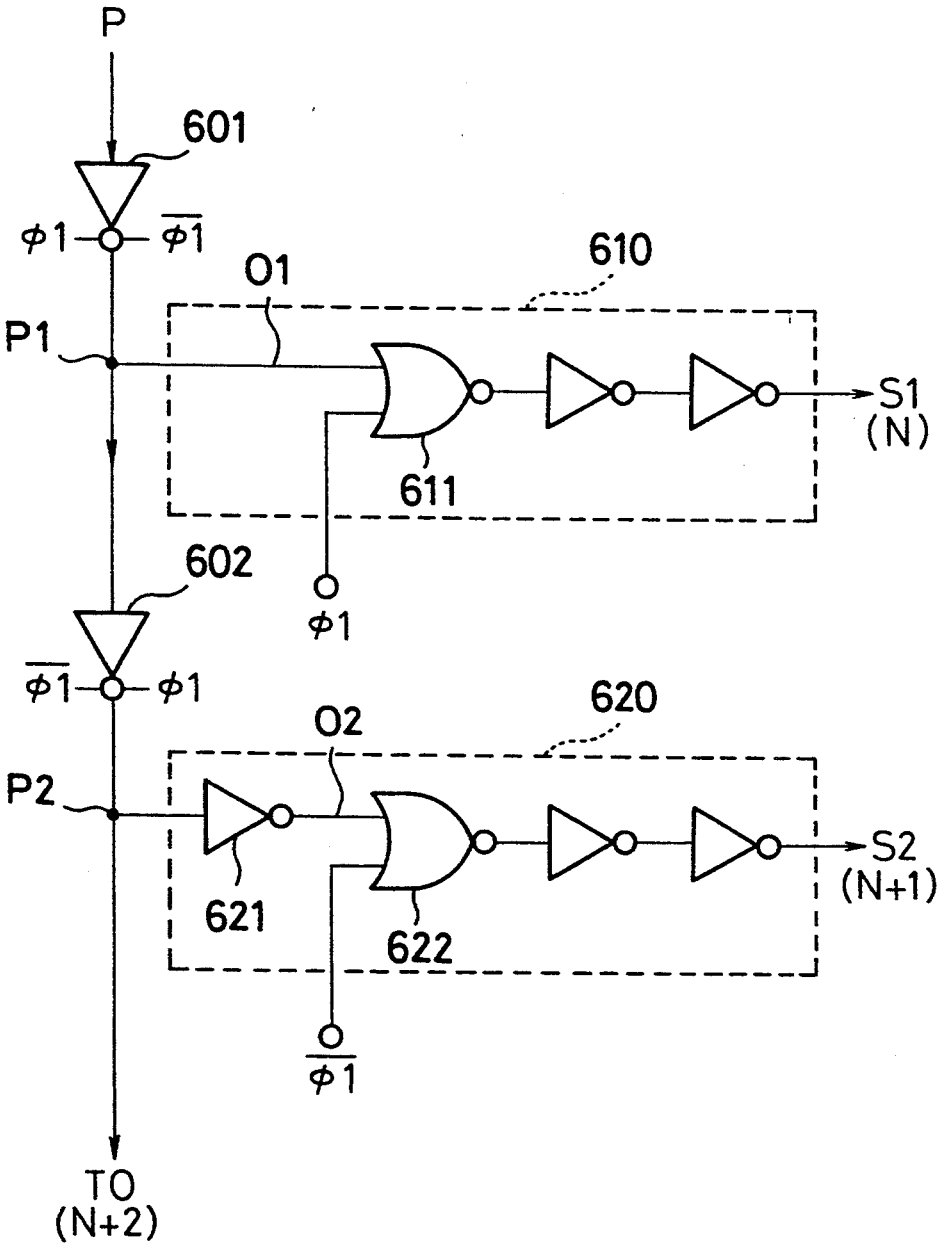
FIG. 6 is the third scanning circuit.

FIG. 6 shows a third example embodying the invention, where a scanning circuit is now a CMOS dynamic circuit.

As shown in the Figure, this example differs from the second one in that no feedback circuitry is included in any stage, since unlike static circuits, voltage attenuation of the signal due to leakage current of transistors is negligibly small. This example also has a feature that a delay transfer circuit for each stage consists of a single element.

In just the same way as in the second example, consecutive inverted signals as represented by S1 and S2 may be obtained in one period of clock Φ1 or $\overline{\Phi 1}$ as shown in FIG. 4.

Although this circuit arrangement has less stability than the static ones when the clock frequency is low, it may hold a preceding signal within a delay transfer circuit over one half the clock period and may further simplify the scanning circuit.

Thus, the third example having such a simple structure requires only small area of substrate and ensures a high yield and great reliability of the scanning circuit. Furthermore, as in the preceding examples, the third example may also doubles scanning frequency of a device for a given clock frequency.

It should be understood that although examples are given for a CMOS static type and a CMOS dynamic type scanning circuit, the invention is not limited to these types. The invention may be equally enabled by NMOS type circuits.

It should be understood also that, so long as the phase of a controlling clock signal is properly selected, the inverters included in the output buffer circuit associated with one of a pair of two consecutive stages, as described in the first and second example above, may be alternatively included in the output buffer circuit associated with the other one of the pair.

I claim:

1. A CMOS type scanning circuit including a multiplicity of thin film integrated circuit stages formed on an insulating substrate, each stage of said scanning circuit comprising:

a delay transfer circuit consisting of a pass transistor for transferring a signal to a next delay transfer circuit in a next stage in synchronism with two clock pulses having mutually inverted phases;

a feedback circuitry connected to said pass transistor of said delay transfer circuit, said signal also being transferred from said pass transistor to said feedback circuitry, said feedback circuitry providing an inverted output signal, said feedback circuit having a feedback loop for inverting said inverted output signal in synchronism with said mutually inverted clock pulses before feeding back to an output of said pass transistor; and an output buffer circuitry having a gate for receiving said inverted output signal from said feedback circuitry, said output buffer circuitry providing a scanning signal when operated by one of said mutually inverted clock pulses.

2. A scanning circuit according to claim 1, wherein said feedback circuitry comprises:

a first inverting amplifier for inverting said output signal of said pass transistor, a second inverting amplifier for further inverting the inverted output of said first inverting amplifier, and a second pass transistor for transferring the inverted output signal of said second inverting amplifier back to said output of said pass transistor, and wherein said gate is comprised of an NOR logic such that one of tile two gates in two consecutive stages receives one of said clock pulses while the other gate receives the other one of said clock pulses.

3. A CMOS type scanning circuit including a multiplicity of serially connected thin film integrated circuit stages formed on an insulating substrate, each stage of said scanning circuit comprising:

a delay transfer circuit including a single delay transfer element for transferring a signal to a next delay transfer circuit in a next stage in synchronism with two clock pulses having mutually inverted phases supplied thereto; and an output buffer circuitry coupled to said single delay transfer element wherein said signal is inverted and also transferred from said single delay transfer element to said output buffer circuitry, said output buffer circuitry providing a scanning signal when operated by one of said mutually inverted clock pulses.

4. A CMOS type scanning circuit including a multiplicity of serially connected thin film integrated circuit stages formed on an insulating substrate, each stage of said scanning circuit comprising:

a single element delay transfer circuit for transferring a signal to a next single element delay transfer circuit in a next stage in synchronism with two clock pulses having mutually inverted phases supplied thereto;

said single element delay transfer circuit being selected from a group consisting of a single pass transistor and a single clocked inverter;

a feedback circuitry connected to said delay transfer circuit, said delay transfer circuit also transferring said signal to said feedback circuitry, said feedback circuitry for providing an inverted output signal and feeding said output signal in synchronism with said mutually inverted clock pulses back to an output of said delay transfer circuit; and an output buffer circuit for receiving said circuitry inverted output signal from said feedback circuitry and providing a scanning signal when operated by one of said mutually inverted clock pulses.

* * * * *